US006923432B1

(12) United States Patent
Martinez

(10) Patent No.: US 6,923,432 B1
(45) Date of Patent: Aug. 2, 2005

(54) SIDE NAIL PULLER

(76) Inventor: Mark Martinez, 174 E. Broadway, Atwater, CA (US) 95301

( * ) Notice: Subject to any disclaimer, the term of this patent is extended or adjusted under 35 U.S.C. 154(b) by 0 days.

(21) Appl. No.: 10/898,877

(22) Filed: Jul. 26, 2004

(51) Int. Cl.[7] ..... B25C 11/00
(52) U.S. Cl. ..... 254/26 R; 254/25; 81/20
(58) Field of Search ..... 254/26 R, 26 E, 254/19, 20; 81/20, 19, 23

(56) References Cited

U.S. PATENT DOCUMENTS

| | | | | | |
|---|---|---|---|---|---|
| 193,967 | A | * | 8/1877 | Knight | 81/23 |
| 740,006 | A | * | 9/1903 | Dempsey | 427/338 |
| 825,560 | A | | 7/1906 | Smith | |
| 1,114,910 | A | | 10/1914 | Reed | |
| 1,411,567 | A | * | 4/1922 | Fisher | 7/146 |
| 2,227,455 | A | | 1/1941 | Lane | |
| 2,542,603 | A | * | 2/1951 | Watters et al. | 81/23 |
| 2,599,651 | A | * | 6/1952 | McClung | 81/23 |
| 2,957,676 | A | | 10/1960 | Palmero | |
| 2,983,297 | A | * | 5/1961 | Wilson | 81/21 |
| 3,150,858 | A | | 9/1964 | David | |
| 4,561,635 | A | | 12/1985 | Lamansky | |
| 4,798,107 | A | | 1/1989 | Furey | |
| 5,159,858 | A | | 11/1992 | Gansen | |
| 5,768,956 | A | | 6/1998 | Coonrad | |
| 5,988,019 | A | | 11/1999 | Coonrad | |
| 6,598,858 | B2 | | 7/2003 | Santa Cruz et al. | |

* cited by examiner

*Primary Examiner*—Lee D. Wilson
(74) *Attorney, Agent, or Firm*—Russell S. Krajec; Krajec Patent Offices, LLC

(57) ABSTRACT

A nail puller mounted on the side of the head of a hammer. The nail puller may be incorporated into a metal hammer head and consist of a groove mounted substantially in line with the handle of the hammer. The nail puller consists of a V-shaped opening suitable for engaging various sizes of nail heads or shanks. The nail puller is located on the side of the hammer, such that the nail is engaged when the hammer is laid nearly parallel to the work surface. The position of the nail puller gives the user nearly 180 degrees of rotation to remove the nail.

16 Claims, 6 Drawing Sheets

SIDE NAIL PULLER

BACKGROUND OF THE INVENTION a. Field of the Invention

The present invention pertains generally to nail pulling devices and specifically to nail pulling devices incorporated into a hammer or other striking tool.

b. Description of the Background

A hammer is the most ubiquitous tool of the carpentry trade. Carpenters use hammers to both drive and remove nails. Carpenters are also known for their creativity and ability to use tools in various ways to solve problems as they come up. For example, even though a traditional claw hammer may have a conventional striking face, a carpenter may use the side of the hammer to drive a nail or strike a tool in specific instances. The more options a carpenter has for using a tool, the more the tool will be used.

Removing nails is a task for which a carpenter may use several different tools, including a claw hammer, a "cat's paw" nail remover, various pry bars, and other tools. Each tool is suited to specific applications depending on the access to the nail and force required to remove the nail from the wood. For example, a nail positioned near the end of a board may be difficult to remove because there may not be enough room at the end of the board for a conventional claw hammer.

Further, the leverage of a conventional claw hammer may be insufficient to remove difficult nails, such as long nails in hardwoods. In such a case, the carpenter may resort to a second tool, such as a pry bar or cat's paw nail remover.

It would therefore be advantageous to provide a device and method whereby a conventional hammer may be used to remove stubborn nails in certain positions that were otherwise difficult or impossible. It would be further advantageous if such a system and method were simple to manufacture and very durable.

SUMMARY OF THE INVENTION

The present invention overcomes the disadvantages and limitations of previous solutions by providing a device and method for removing nails by using a nail puller mounted on the side of the head of a hammer. The nail puller may be incorporated into a metal hammer head and consist of a groove mounted substantially in line with the handle of the hammer. The nail puller consists of a V-shaped opening suitable for engaging various sizes of nail heads or shanks.

The nail puller is located on the side of the hammer, such that the nail is engaged when the hammer is laid nearly parallel to the work surface. The position of the nail puller gives the user nearly 180 degrees of rotation to remove the nail.

An embodiment of the present invention may include a striking tool comprising: a handle; a unitized head comprising: at least one striking end having a striking axis; a handle shaft having an end and a handle axis; a striking plane defined by the plane of movement in which the striking end strikes an object, the striking plane being coplanar with the striking axis and the handle axis; two diverging nail engagement edges located proximal to the junction of the striking axis and the handle axis and offset from and substantially parallel to the striking plane, the nail engagement edges diverging in the direction of the handle end.

Another embodiment of the present invention may include a striking tool comprising: a handle having a handle axis; a head having a head axis substantially coplanar with the handle axis; a striking plane defined by the coplanar handle axis and the head axis; and a single web proximally located to the junction of the handle axis and the head axis, the web offset from the striking plane, the web having a divergent opening oriented substantially in the direction of the handle axis, the opening diverging in the direction from the head axis toward the handle.

The advantages of the present invention include that nails may be removed using a hammer in a simple and intuitive manner. The nail puller may be incorporated into hammer designs without adding significant cost or complexity.

DETAILED DESCRIPTION OF THE INVENTION

Figure 1:
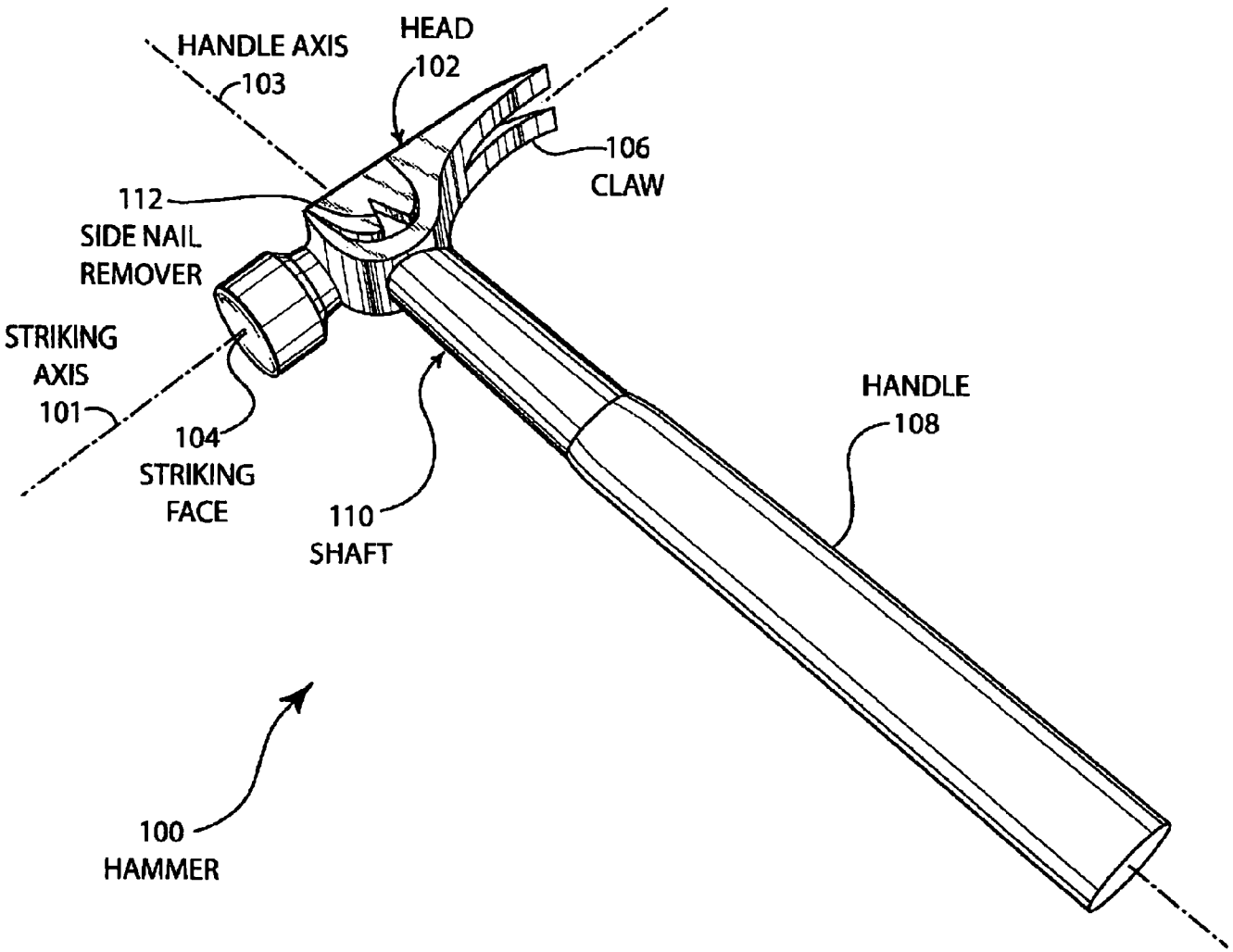
FIG. 1 is a perspective illustration of an embodiment of the present invention showing a hammer.

FIG. 1 illustrates an embodiment 100 of the present invention showing a hammer 100 having a head 102 that has a striking face 104 and claw 106. The handle 108 extends from the head 102. The handle shaft 110 is integral to the head 102. The head 102 contains a side nail remover 112. The striking axis 101 and handle axis 103 are shown approximately perpendicular to the striking face 104 and approximately parallel to the shaft 110, respectively.

Figure 2:
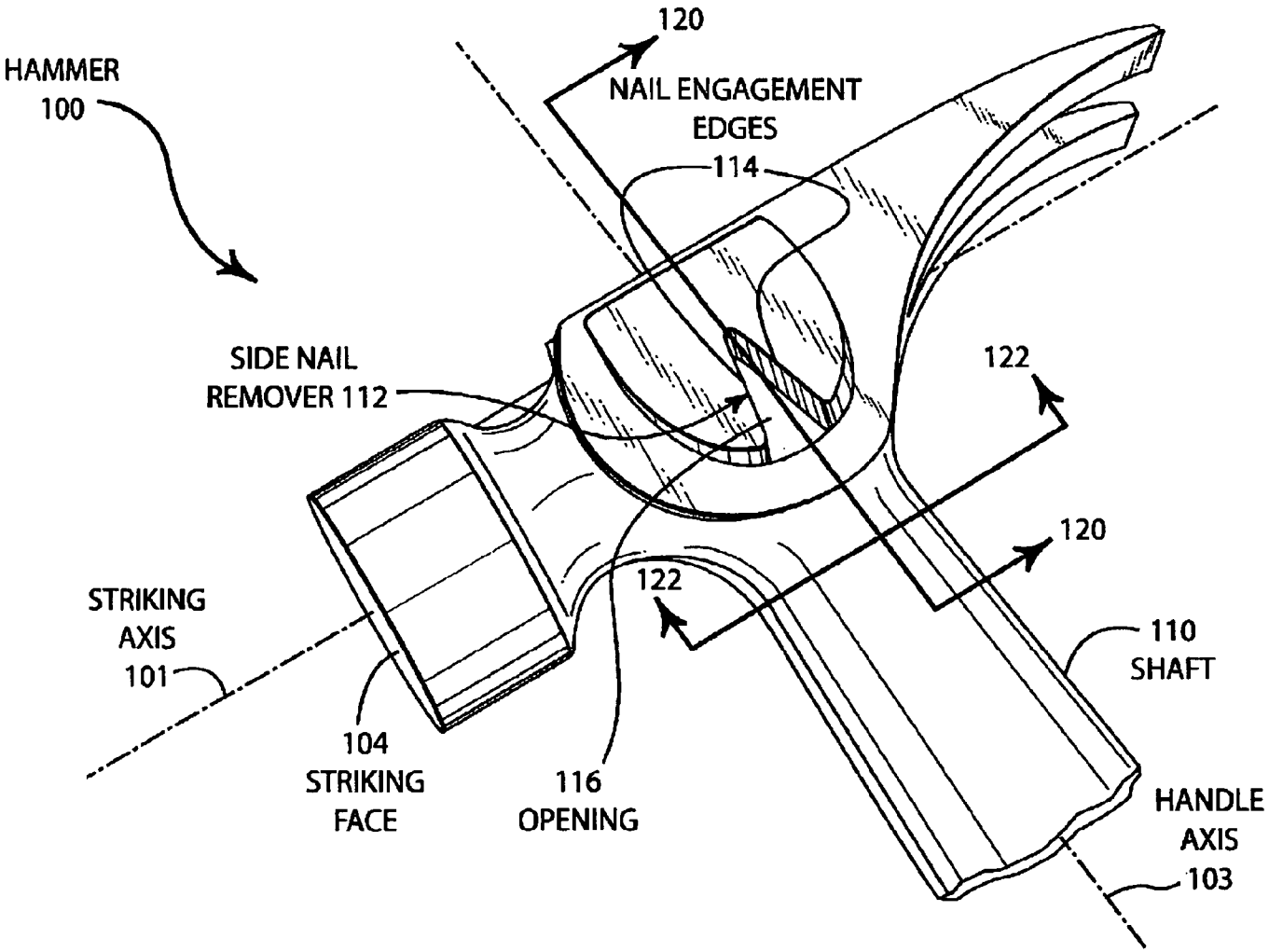
FIG. 2 is a perspective illustration of a close up view of the embodiment of FIG. 1.

FIG. 2 illustrates a closer view of embodiment 100 of a hammer. The striking face 104, shaft 110, and side nail puller 112 are shown.

The nail puller 112 is comprised of two nail engagement edges 114 and the opening 116. The opening 116 is designed to allow the head of a nail fit inside the opening, and the tapered configuration of the nail engagement edges 114 allows the hammer 100 to be slid over the nail until the shank of the nail is grasped by the edges 114. Once the nail is engaged, the hammer 100 may be rotated about an axis approximately perpendicular to the striking face 104 to remove the nail.

The nail puller 112 is fashioned by casting or forging the opening 116 into the hammer 100. The embodiment 100 is a unitized cast hammer wherein the shaft 110 is integral to the head 102.

Figure 3:
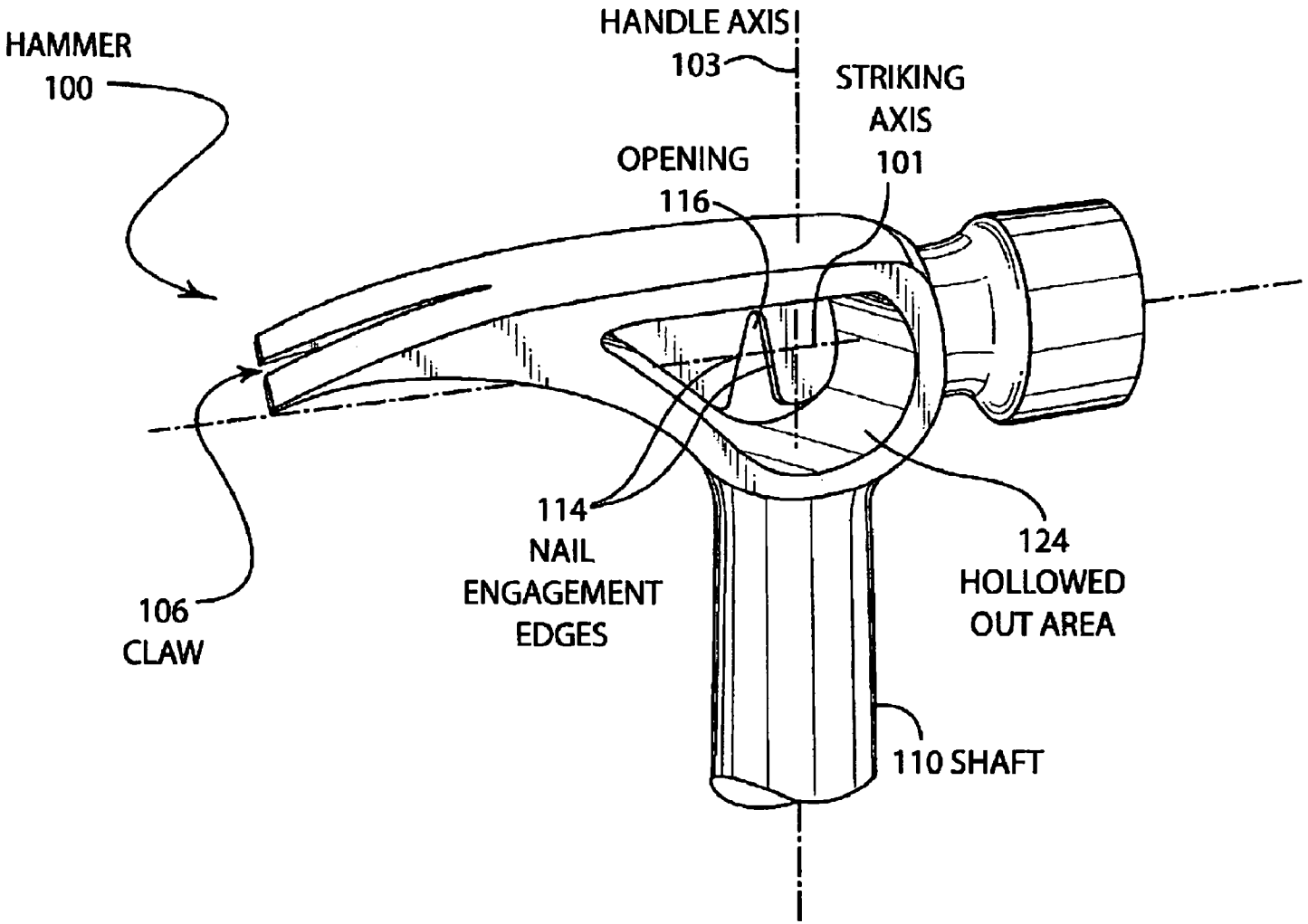
FIG. 3 is a perspective illustration of a close up view of the back side of the embodiment of FIG. 1.

FIG. 3 illustrates a close up view of the back side of the embodiment 100 of a hammer. The claw 106 and shaft 110 are shown. The nail engagement edges 114 and the opening 116 are also illustrated. Because the shaft 110 and head 102 are a unitized piece of metal, a hollowed out area 124 can be placed behind the side nail puller 112.

In embodiment 100, the side nail puller 112 may be manufactured from a single web that spans the area between the striking face 104 and the claw 106. In embodiments with a separate fiberglass or wooden handle, the area shown as the hollowed out area 124 would normally be the junction between the handle and the head of a hammer.

The hollowed out area 124 allows the side nail puller 112 to engage a nail at any point along its shank. For example, if a nail has a crooked head or bent shank, the head of the nail may be fit through the wide end of the opening 116 and the side nail puller 112 may be slid until the nail engagement edges 114 firmly grip the nail shank near the board from which it is to be removed. The bent head and crooked portion of the nail may protrude into the hollow area 124 without compromising the effectiveness of the nail puller.

Further, because the handle and head are unitized, the side nail puller 112 may be manufactured as a cast or forged feature, thus making the nail puller 112 a very low cost addition to a standard unitized head hammer. In some embodiments, the side nail puller 112 may be manufactured by machining, punching, or other metal removal process. In still other embodiments, the side nail puller 112 may be mechanically attached to the head 102 by welding, brazing, fastening, or other means.

The embodiment 100 may be manufactured of any suitable material, preferably metallic. For example, embodiments of titanium, steel, and various alloys are possible. Further, composite materials such as reinforced plastics or thermoset materials are envisioned. In embodiments of composite materials, the side nail puller 112 may be a metallic insert that is molded or attached to a composite head.

Striking tools other than a hammer may be used with the side nail puller 112. For example, a hatchet, ball peen hammer, sledge, or other striking tool may have a side nail puller 112 fashioned in a similar manner.

The usefulness of the side nail puller 112 is that it may be used to remove nails in addition to other features on the hammer. For example, in some circumstances, the claw 106 may not have enough clearance nearby the nail on which to rest the fulcrum portion of the head. Similarly, the distance between the pulling point of the claw 106 and the pivot or fulcrum point of the head may be longer than the distance between the pulling point and fulcrum point of the side nail puller 112. In such a case, the pulling force required on the handle 108 to remove the nail is substantially less for the side nail puller 112 than with the claw 106.

Various head geometries and shapes may be used to increase and decrease the leverage exerted on the handle 108 when using the side nail puller 112. For example, by rounding over the top surfaces of the hammer head, the nail pulling action of the side nail puller is smoother than when the head has more of a squared top.

Figure 4A:
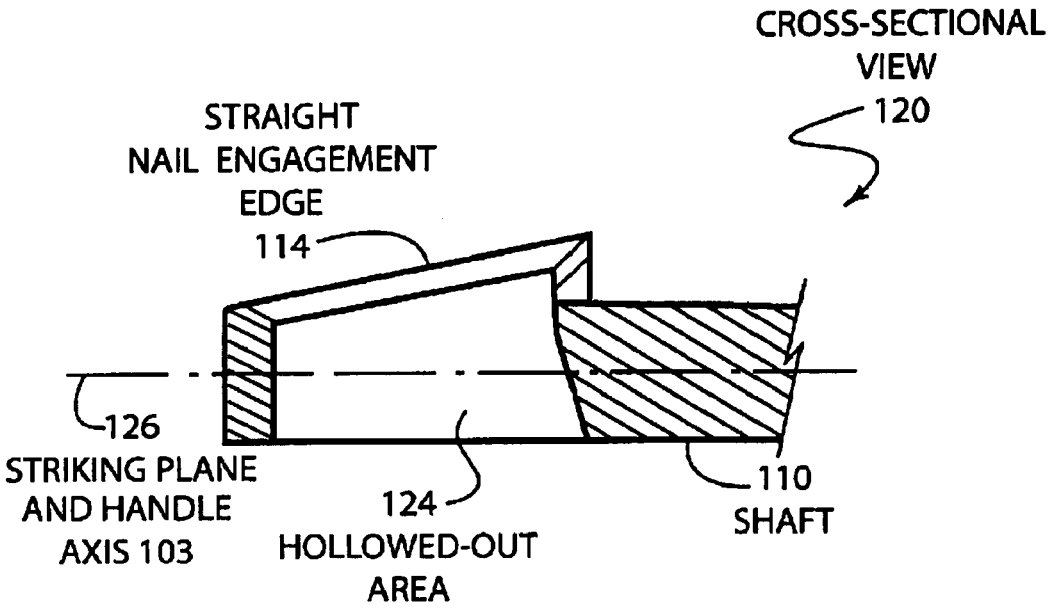
FIG. 4A is a cross-sectional illustration of a first embodiment of a cross-section 120 from FIG. 1.

FIG. 4A illustrates a first embodiment of a cross-sectional view 120 from FIG. 1. The shaft 110 is shown in cross-section along with the striking plane 126. The nail engagement edge 114 is shown as well as the hollowed out area 124.

The striking plane 126 is the approximate center plane of the striking tool and the plane in which the tool is swung to strike an object. The nail engagement edge 114 is shown slightly canted upward in the illustration, but generally parallel to the striking plane 126. In some embodiments, the nail engagement edge 114 may be very close to parallel to the striking plane 126.

Figure 4B:
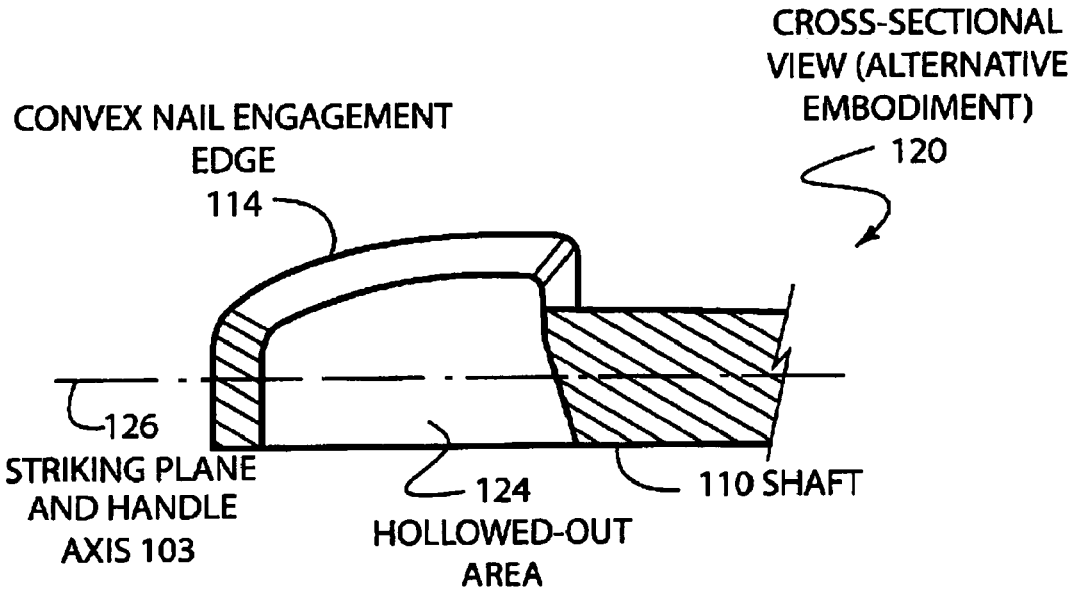
FIG. 4B is a cross-sectional illustration of a second embodiment of a cross-section 120 from FIG. 1.

FIG. 4B illustrates a second embodiment of a cross-sectional view 120 from FIG. 1. The shaft 110 is shown in cross-section along with the striking plane 126. The nail engagement edge 114 is also shown as well as the hollowed out are 124.

The nail engagement edge 114 is curved upward in a convex manner, when viewed from the working surface. The convex shape of nail engagement edge 114 may allow the side nail puller 112 to dig into a substrate, such as wood, and engage a nail head. The shape may be a similar design as for a 'cat's paw' or similar nail extracting tools.

Figure 5A:
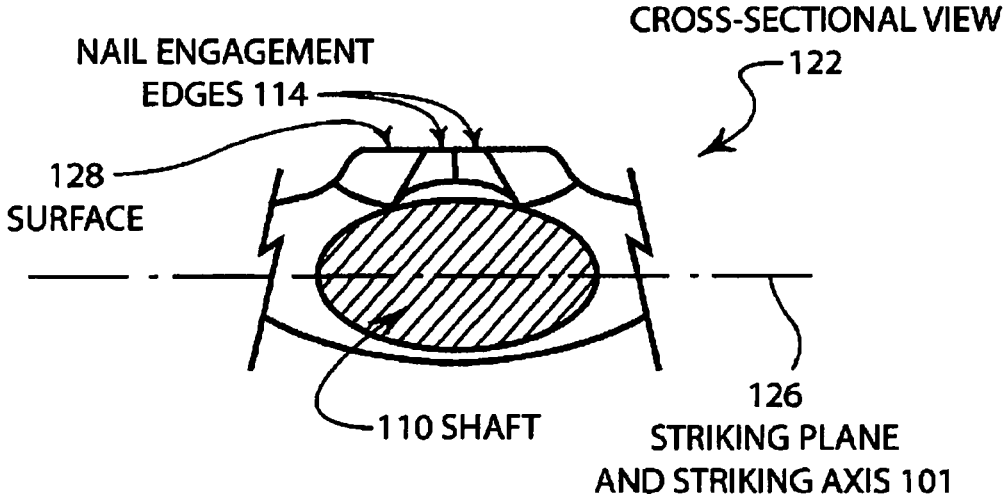
FIG. 5A is a cross-sectional illustration of a first embodiment of a cross-section 122 from FIG. 1.

FIG. 5A illustrates a first embodiment of a cross-sectional view 122 from FIG. 1. The shaft 110 is shown in cross-section along with the striking plane 126. The nail engagement edges 114 are formed by the surface 128, which is substantially flat.

Figure 5B:
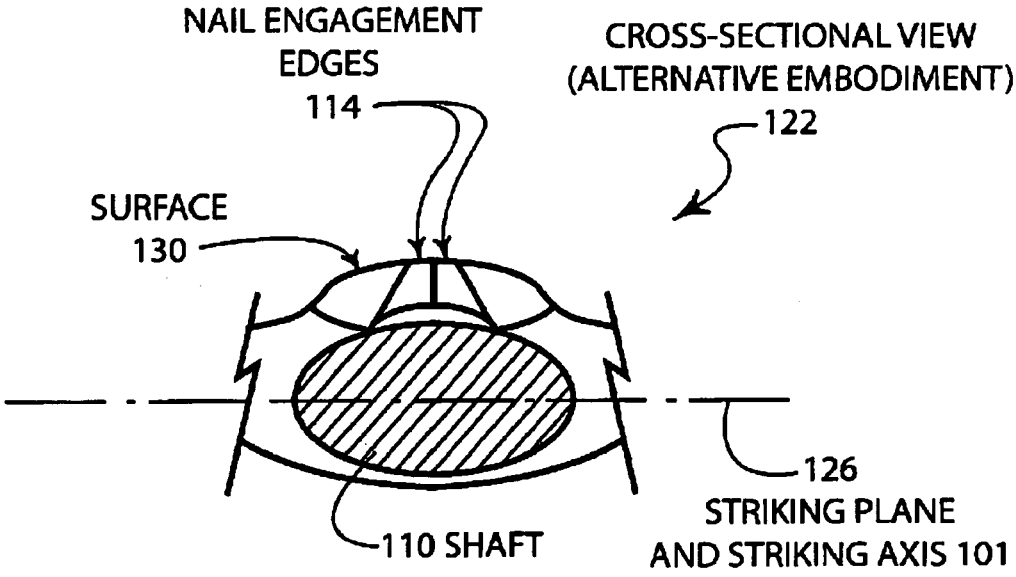
FIG. 5B is a cross-sectional illustration of a second embodiment of a cross-section 122 from FIG. 1.

FIG. 5B illustrates a second embodiment of a cross-sectional view 122 from FIG. 1. The shaft 110 is shown in cross-section along with the striking plane 126. The nail engagement edges 114 are formed by the surface 130, which is substantially curved in a convex manner.

The surface 130 and nail engagement edges 114 may be formed in a convex manner similar to that of other nail extracting tools, such as a 'cat's paw.' The curvature of the surface 130 may be designed to dig into a substrate, such as wood, and engage a nail to be extracted. The particular angle of the nail engagement edges 114 that form the opening 116 and the curvature (if any) of the surface 130 may be varied to give more or less ease of engagement of the nail and structural integrity of the side nail puller 112.

Figure 6:
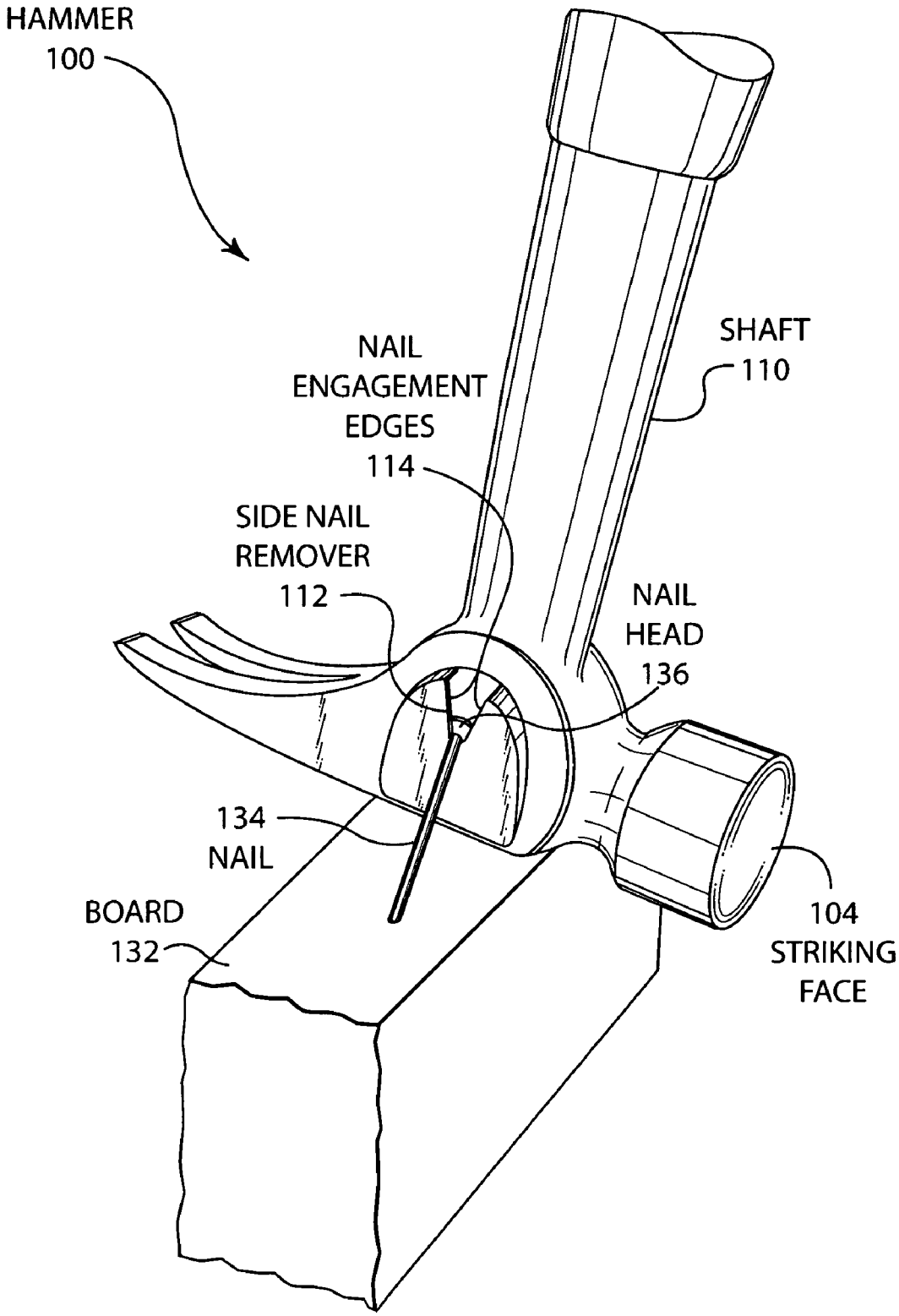
FIG. 6 is a perspective illustration of an embodiment of a hammer in the process of removing a nail from a board.

FIG. 6 illustrates an embodiment 100 of a hammer in the process of removing a nail 134 from board 132. The hammer 100 includes a striking face 104, a shaft 110, and the side nail puller 112. The nail engagement edges 114 are holding the head of the nail 136.

When using the side nail puller 112, the hammer is laid almost parallel to the board 132 to engage the nail 134. This gives the user almost 180 degrees of rotation to remove the nail. With the embodiment 100 shown, a 16d nail may be removed completely with one movement.

The leverage of the handle is magnified because the fulcrum point when using the side nail puller 112 is usually close to the nail 134. As those skilled in the art will appreciate, by having a larger head on the hammer, a side nail puller 112 may have a longer stroke by which a nail is removed, but may have less leverage by which to remove it.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A striking tool comprising:

a handle;

a unitized head comprising:

at least one striking face having a striking axis substantially perpendicular to said striking face;

a handle shaft having an end and a handle axis substantially parallel to said handle shaft;

a hollowed out through portion located proximal to the junction of said striking axis and said handle axis which is covered at least on one side by a side nail puller having two diverging nail engagement edges.

2. The striking tool of claim 1 where in said nail engagement edges diverge in the direction of said handle end.

3. The striking tool of claim 1 wherein said striking end face comprises a substantially fiat striking surface.

4. The striking tool of claim 1 further comprising a nail removal claw oriented substantially symmetrical about said striking plane.

5. The striking tool of claim 1 wherein said nail engagement edges are supported by a convexly curved web.

6. The striking tool of claim 1 wherein said nail engagement edges are convexly curved.

7. A striking tool comprising:

a handle shaft having a handle axis substantially parallel thereto;

a bead having a striking axis substantially coplanar with said handle axis and substantially perpendicular to a striking face; and a hollowed out through portion of said head proximally located to the junction of said handle axis and said striking axis which is covered by at least one side nail puller having a divergent opening oriented substantially in the direction of said handle axis;

wherein said head and said handle shaft are composed of a single piece of material.

8. The striking tool of claim 7 wherein said handle axis and said striking axis are substantially perpendicular.

9. The striking tool of claim 7 wherein said divergent opening is oriented substantially parallel to said handle axis.

10. The striking tool of claim 7 wherein said divergent opening is oriented substantially collinear to said handle axis and substantially parallel to said striking plane.

11. The striking tool of claim 7 wherein said handle comprises a metallic shaft.

12. The striking tool of claim 7 wherein said head comprises a substantially flat striking surface substantially perpendicular to said head axis.

13. The striking tool of claim 7 further comprising a nail removal claw oriented substantially symmetrical about said striking plane.

14. The striking tool of claim 7 wherein said divergent opening is supported by a substantially flat web offset from and substantially parallel to said striking plane.

15. The striking tool of claim 7 wherein said divergent opening is supported by a convexly curved web.

16. The striking tool of claim 7 wherein said divergent opening is convexly curved.

* * * * *